US005605311A

United States Patent [19]

McGrath et al.

[11] Patent Number: 5,605,311

[45] Date of Patent: Feb. 25, 1997

[54] UPPER TORSO SUPPORT FOR A WORKSTATION

[76] Inventors: Michael McGrath, 415 Summerhill Ter., Alpine, Calif. 91901; Joseph McGrath, 6841 Xana Way, Carlsbad, Calif. 92009; Josephine McGrath, 415 Summerhill Ter., Alpine, Calif. 91901

[21] Appl. No.: 309,119

[22] Filed: Sep. 20, 1994

[51] Int. Cl.[6] ..... B68G 5/00

[52] U.S. Cl. ..... 248/118; 248/918; 108/50

[58] Field of Search ..... 248/118, 118.1, 248/118.3, 118.5, 918, 124, 183; 108/43, 50

[56] References Cited

U.S. PATENT DOCUMENTS

| | | | |
|---|---|---|---|
| 1,737,350 | 11/1929 | Balcer . | |
| 2,113,882 | 4/1938 | Galt | 4/254 |
| 2,759,525 | 8/1956 | Ries | 155/22 |
| 2,773,542 | 12/1956 | Chasin | 155/1 |
| 2,903,714 | 9/1959 | Grondona | 4/254 |
| 2,950,890 | 8/1960 | Hough, Jr. | 248/118 |
| 3,741,514 | 6/1973 | Snurr | 248/412 |
| 4,621,781 | 11/1986 | Springer | 248/118 |
| 4,834,357 | 5/1989 | Bodenmiller | 248/118 |
| 4,884,842 | 12/1989 | Finkelstein | 297/344.18 |
| 4,894,871 | 1/1990 | Schmerler | 4/254 |
| 5,056,743 | 10/1991 | Zwar et al. | 248/118 |
| 5,072,905 | 12/1991 | Hyatt | 248/118 |
| 5,074,501 | 12/1991 | Hölttä | 248/118.3 |
| 5,104,073 | 4/1992 | VanBeek et al. | 248/118.3 |
| 5,108,057 | 4/1992 | Dandy, III et al. | 248/118 |
| 5,135,190 | 8/1992 | Wilson | 248/118.1 |
| 5,158,256 | 10/1992 | Gross | 248/118.3 |
| 5,161,760 | 11/1992 | Terbrack | 248/118 |
| 5,174,223 | 12/1992 | Nagy et al. | 108/50 |
| 5,195,705 | 3/1993 | Kline et al. | 248/118.3 |
| 5,209,452 | 5/1993 | Goldberg | 248/676 |
| 5,215,282 | 6/1993 | Bonutti | 248/118 |
| 5,224,429 | 7/1993 | Borgman et al. | 108/50 |
| 5,265,835 | 11/1993 | Nash | 248/118 |
| 5,281,001 | 1/1994 | Bersten et al. | 248/118 |
| 5,342,006 | 8/1994 | Tice | 248/118 |
| 5,351,897 | 10/1994 | Martin | 248/118 |
| 5,370,346 | 12/1994 | Long | 248/118.5 |
| 5,398,896 | 3/1995 | Terbrack | 248/118.5 |

OTHER PUBLICATIONS

Ignatius, Ellen "The High Cost of Keyboard Injuries", PC World, Mar. 1994 p. 45.

Feder, Barnaby J. "A Spreading Pain, and Cries for Justice", New York Times Business Section, Jun. 5, 1994.

ARMx® Product Flyer.

I9600 Industries Choice Desk Rest™ Advertisement.

DataArm/Wrist Trolley/Keyboard Platform Advertisements.

Articulating Arm Support Advertisement.

Power Wheels, Model 16 Advertisement.

ARMx® Product Price List, MyoNetics® Inc.

*Primary Examiner*—Karen J. Chotkowski

*Assistant Examiner*—Anita M. King

*Attorney, Agent, or Firm*—Knobbe, Martens, Olson, Bear, LLP

[57] ABSTRACT

An adjustable, sturdy upper body support system for keyboard operators includes a pair of adjustable arm rests mounted on a rigid frame which can be incorporated into a standalone system or into a desk workstation system. In either embodiment, the frame includes a portion extending forward under the arm rests to prevent the device from tipping. The arm rests can be pivoted about two axes relative to a U-shaped frame slidable within a primary frame underneath a keyboard platform. The standalone version includes outwardly diverging feet for added maneuverability and can be positioned underneath an existing desk. In one version, the upper body support is mounted to a height adjustable desk workstation. Another combined upper body support and desk system includes a height adjustable desk positionable with respect to the arm rests.

14 Claims, 10 Drawing Sheets

UPPER TORSO SUPPORT FOR A WORKSTATION

FIELD OF THE INVENTION

The present invention relates to an upper body support apparatus for workstations and, more particularly, to an adjustable, sturdy upper body support and work platform incorporated into a standalone frame or into a desk workstation.

BACKGROUND OF THE INVENTION

Our modern technologically oriented society has what appears to be an insatiable demand for information. The preferred form for efficient storage and access of such information is in the memory of a computer or database. Consequently, there is an ever increasing need for word processors or data entry operators to input the large volumes of information. These workers by definition must spend many hours doing repetitive tasks in a constant sitting position. In addition to the most demanding data entry positions of telephone operators, supermarket check-out clerks and such, a growing number of white collar workers up to and including executives of large corporations are relying more and more on computer use. Furthermore, other tedious and repetitive tasks such as machine shop and assembly line work require the worker to assume a stable body position with the arms and hands manipulating tools and work pieces within a confined area.

Stationary, repetitive work may eventually lead to many different kinds of health problems, chiefly among those being any one of a number of maladies classed as "repetitive strain injures" (RSI). RSI is a cumulative condition that causes everything from persistent aches in arms and hands to crippling, career-ending pain. Every year, thousands of people must leave work because of RSI. The cost to companies in both lost productivity and worker's compensation claims is enormous. The most commonly reported RSI is a condition known as Carpal Tunnel Syndrome. This condition occurs when some or all of the nine wrist tendons swell to crowd the nearby median nerve which shares space with the tendons within the carpal tunnel. Carpal Tunnel Syndrome accounts for a large portion of the occupational injuries reported each year to the Bureau of Labor Statistics. Furthermore, surgery for Carpal Tunnel Syndrome is the second most common surgical procedure in the nation. In addition to the more widely known Carpal Tunnel Syndrome, there has been an increase in the number of reported cases of arm tendinitis and lumbar back pain, among other ailments, caused by less than optimum work station environments.

A worker who suffers a disabling injury from such chronic physical stress can cost a company a substantial amount of money in Workman's Compensation claims. Indeed, the average Workman's Compensation claim in cases such as these is currently approximately $70,000. Even more ominous for businesses is the increasing number of personal injury suits filed by employees who claim disabling on-the-job injuries from inadequate workstation environments. In addition to this large financial risk, various government agencies are implementing new laws intended to pressure employers to provide adequate working environments to minimize such injuries. The Occupational Safety and Health Administration (OSHA), for example, plans to force all types of businesses to cut the risk of RSI's.

In response to these health problems, there have been numerous attempts at supporting the forearms and wrists of typists to prevent such nerve aggravation. Many offices provide simple padded supports along the front of the keyboard upon which the operator may rest his or her wrists. Unfortunately, although this helps alleviate wrist and finger fatigue, the forearm and upper body is not supported and may experience discomfort. Other solutions have provided adjustable chair arm rests for supporting the forearm during typing or other such repetitive work. Unfortunately, many office chairs do not include arm rests.

There have been several specialized apparatuses adaptable to a desk or a chair for supporting the forearm. One example is shown in U.S. Pat. No. 5,215,282 to Bonutti. This patent discloses an assembly which includes a pair of padded arm rests pivotably mounted on tubes attached to the underside of a desk or to a chair or chair arm. The structure supporting the arm rests is relatively lightweight and the device is intended only for supporting a short portion of a person's forearm. Further, although some pivoting adjustment is possible, and lateral movement is briefly mentioned, the total range of movement, and particularly the range of movement in a vertical direction, of any arm rest attached to the fixed height desk or chair is necessarily limited.

Another wrist and forearm support is shown in U.S. Pat. No. 5,072,905 to Hyatt. The device hangs on the front edge of a desk and has two extending support members pivotable about attachment bolts. Again, the range of motion, especially in the vertical direction, is limited and the device is not suited for supporting excessive loads. In particular, since the device hangs on the front edge of the desk and the support members extend outward from the desk in a cantilevered fashion, excessive loads on the support members could result in the device becoming detached from the front of the desk or could also result in overbalancing the desk. Such excessive loads could result from the word processor or typist resting their upper body weight on the support surfaces.

U.S. Pat. No. 5,135,190 to Wilson and U.S. Pat. No. 5,281,001 to Bergsten et al. show other desk- or chair-mounted forearm support systems. U.S. Pat. No. 5,158,256 to Gross and U.S. Pat. No. 5,161,760 to Terbarck show accessories for supporting the wrist and forearm in front of a keyboard. In short, there have been numerous devices designed for supporting the wrist and/or forearm, and specifically designed to prevent the type of chronic injuries common to word processors.

Unfortunately, as mentioned above, prior wrist and/or forearm supports suffer from being relatively lightweight in construction and thus unsuitable for supporting large loads. The result is that the operator cannot rest his or her entire upper body weight on the support for fear of the device or supporting desk or chair breaking. Whether consciously or not, the operator then maintains the arms in a slight state of tension with a portion of their weight supported by the shoulders and back. Many injuries occur from these repetitive tasks, farther up on the arm and beyond to the neck, back muscles and tendons as a result of supporting this portion of the weight of their arms by these muscles and tendons for extended periods of time.

Recently, with the passage of the Americans With Disabilities Act (ADA) of 1992, employers are required to make workstations accessible to all employees, including the disabled. Often, persons in wheelchairs are prone to leaning heavily to one side over long periods. Prior forearm and wrist support systems are unable to provide adequate support for such heavy loads. There is thus a regulatory incentive for businesses to accommodate persons with disabilities to make their workstations ergonomically comfortable.

For some years now, there has been a need for a more sturdy workstation support and preferably one which has wider ranges of movement and provides more alternatives for the types of equipment used with it than do prior designs.

SUMMARY OF THE INVENTION

The present invention provides a solution to problems with prior wrist and forearm supports by increasing the strength and range of motion of an upper body support apparatus, and providing configurations of that apparatus that allow for options in things such as use and positioning of a mouse contact surface. The support apparatus can be incorporated into a standalone system or can be attached to a workstation. The upper body support apparatus comprises a pair of arm rests pivotably attached about two axes and slidable with respect to a frame. A wrist support pad and a keyboard platform are also supported above the frame. The arm rests are padded and, in use, are positioned on both front lateral corners of the frame to provide, along with the wrist support pad, a uniform height upper body support which is both soft and sturdy.

In a preferred embodiment, the upper body support apparatus includes a pair of arm rests having sturdy support assemblies attached to a central primary frame, the wrist support pad and the keyboard platform. The arm rest support apparatus preferably comprises a U-shaped frame on either side of the central frame and is adapted to slide transversely into tubular-members of the frame. A linkage bar is pivotably attached about a first axis to a connecting portion of the U-shaped frames and extends forward to pivotably attach about a second axis to an arm rest bracket rigidly mounted within the arm rests. The U-shaped frame thus may be slid transversely relative to the fixed central frame, while the arm rests can be pivoted about two axes relative to the U-shaped frame.

In accordance with another aspect of the present invention, the arm rest support assembly and arm rest are of an extremely sturdy construction while maintaining a very low profile underneath to provide more room for a user's legs. More specifically, the U-shaped frame is formed of square tubular steel while the linkage bar is preferably a solid steel member. The pivot attachments of the linkage bar to the U-shaped frame and also to the arm rest connection bracket are made by relatively large pivot bolts. Further, the arm rest connection bracket is integrally formed with an inner rib fixedly attached to a support plate, thus forming a skeleton within the arm rest. The support plate is preferably fastened into a recess in a lower layer of medium density fiberboard of the arm rest. The rib, support plate, and lower layer of medium density fiber board comprise an extremely strong support platform on which an operator may place his or her entire weight without fear of the apparatus buckling. The arm rests are further bolstered by the addition of an intermediate layer of plywood above the medium density fiberboard, and are softened by two upper layers of urethane foam enclosed by a vinyl cover. A catch member transversely slidable with respect to the U-shaped frame can be retracted outward to form a stop for maintaining the arm rest in a horizontal position or, alternatively, can be slid into the U-shaped frame to allow the arm rests to pivot downward out of the way.

In accordance with one aspect of the present invention, the upper body support apparatus can be incorporated into a standalone frame having height adjustable legs and a pair of forwardly diverging feet. The height adjustable legs can position the upper body support apparatus optimally with respect to a seated user or, alternatively, can be raised up to provide a support for a standing user. In another embodiment, the upper body support apparatus can be mounted to a frame having a height adjustable work platform adjacent the keyboard platform. The work platform may provide a support for a keyboard, monitor, or other device. In a still further embodiment, the upper body support apparatus can be slidably mounted to a rigid frame underneath a larger, height-adjustable desk work station. The desk work station may be formed in an L-shape with a central recess accommodating the upper body support apparatus. In this version, the arm rests have the same range of motion as in the previous embodiments. Another work station may be formed as a corner piece and have a recess for accommodating the upper body support apparatus in the inner corner of the desk.

A still further feature of the upper body support apparatus is a height and tilt adjustable keyboard platform. The platform is disposed rearwardly of the elongated wrist support pad and can be raised or lowered from underneath with a plurality of adjustment screws. Further, the keyboard platform can be angled with the adjustment screws to suit the particular user. Additionally, the keyboard split platform is sized to accommodate both the keyboard and a separate mouse pad. The mouse pad can be placed on either the right or left side of the keyboard depending on the hand of the operator.

These and other objects and features of the present invention will become more fully apparent from the following description and appended claims taken in conjunction with the accompanying drawings.

DESCRIPTION OF THE PREFERRED EMBODIMENTS

The following description refers to various illustrated embodiments of an upper body support system incorporated into several rigid support assemblies comprising various workstations. Each of the different versions will be separated by subheadings although they all share the common central upper body support system.

Standalone Support Assembly

Figure 1:
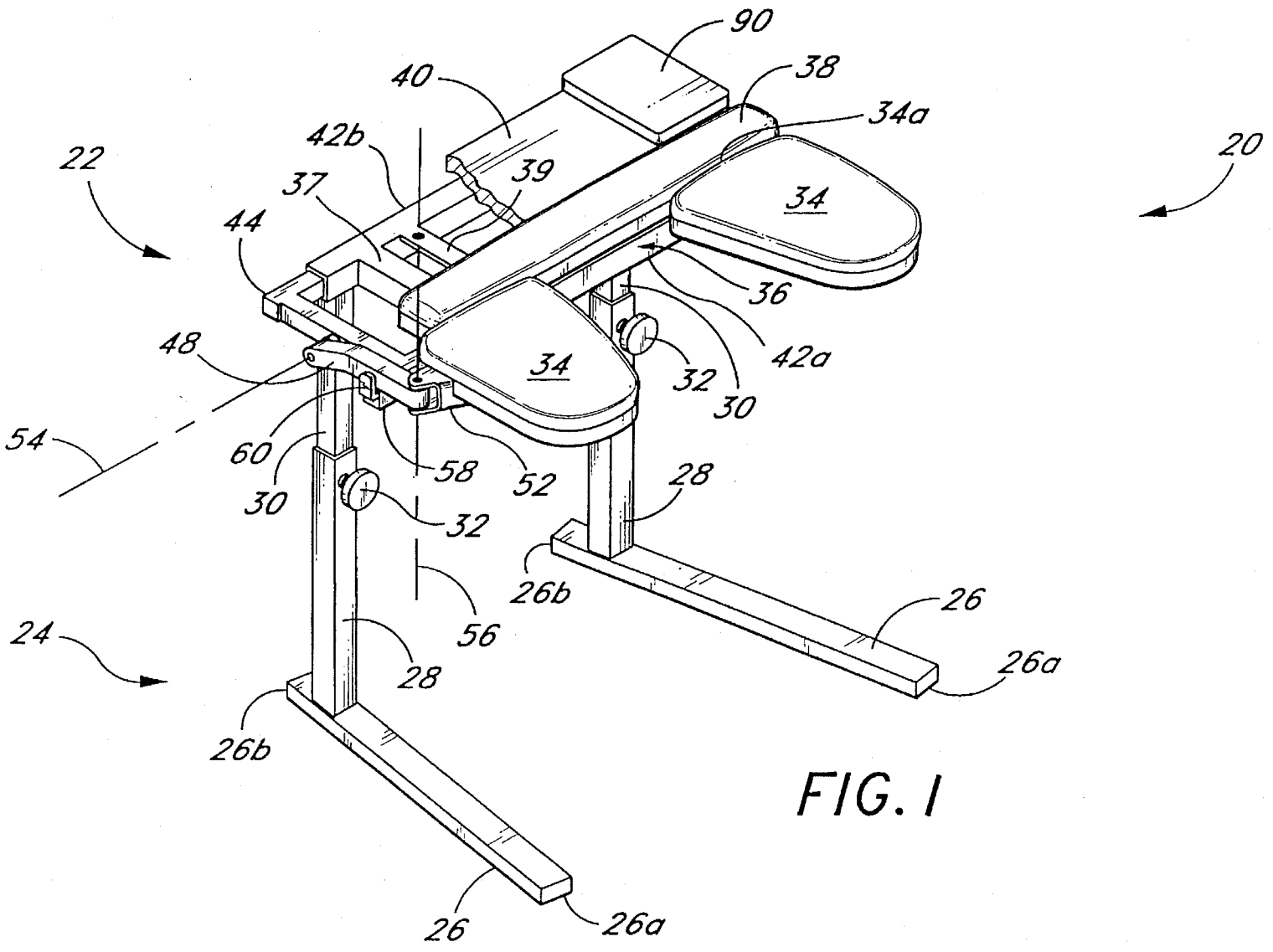
FIG. 1 is a perspective view of a standalone version of an upper body support apparatus in accordance with the present invention.

A standalone version of an upper body support system of the present invention is designated as 20 in FIG. 1. The system 20 generally comprises an adjustable upper body support apparatus 22 mounted on a height adjustable stand 24, together defining a support frame. The stand 24 comprises a pair of outwardly diverging feet 26 welded to a pair of upstanding lower tubular stanchions 28 sized to slidably receive a pair of upper tubular stanchions 30. The adjustable upper body support 22 is rigidly attached, such as by welding, to the upper ends of the tubular stanchions 30. The upper body support 22 extends generally horizontally forward from the tubular stanchion 30, and parallel to the lower feet 26. A pair of height adjusting knobs 32 allow tightening of a threaded rod (not numbered) passing through threaded apertures in the lower tubular stanchions 28 against the upper tubular stanchions 30. Thus, the height of the upper body support 22 can be adjusted above a base surface on which the feet 26 rest, as seen by double-headed arrow 33 of FIG. 3. In one preferred embodiment, the height of the standalone system 20 can be adjusted between 24 inches and 39 inches, and it has a width of approximately 26 inches.

Height adjustment of the upper body support 22 is in itself a vast improvement over prior wrist and forearm supports attached to fixed height desks or to chair arms. The ability to adjust the height of the arm support is perhaps the single most important feature to avoid bad posture and attendant back and neck problems. Furthermore, the wide range of adjustment of the height allows a user to either sit or stand and utilize the upper body support 22.

The standalone upper body support system 20 shown in FIG. 1 is designed to be placed between a worker, such as a keyboard operator (not shown), and a desk or other work platform. In the most common usage of the system 20, a keyboard operator sits in an armless chair in front of the system and between the lower support feet 26. In a highly desirable method of customizing a workstation, the user first adjusts his or her seat to the most comfortable height. Then, the support system 20 is adjusted to an ergonomically optimum height with respect to the individual sitting at the preferred seat height. The optimum position has the user sitting upright and the arms resting naturally on the upper body support apparatus 22. The encompassing and sturdy nature of the present invention encourages the user to accommodate to the correct position to minimize chronic injuries from poor posture.

At the lower portion of the stanchions 28, the support feet 26 diverge slightly outward from a centerline of the system by approximately 15°. Thus, forward ends 26*a* of the feet are spaced farther apart than rear ends 26*b*. This divergence increases the area between the forward ends 26*a* of the feet and provides more maneuvering room for the user's chair, which is typically on rollers. Furthermore, the skewed angle at which the feet 26 meet the lower stanchions 28 increases the strength in bending of the welded joint between the feet and the lower stanchions. The bending moment applied at the joint by someone leaning on the upper body support apparatus 22 results in a lower stress due to the higher area moment of inertia of the joint, having a skewed angle, than for a joint where the feet point straight forward. This is perhaps best envisioned by the fact that it is more difficult to bend a square tubular member about an axis which is not parallel to one of its sides. In other words, the area moment of inertia is greater for these nonorthogonal bending axes. Finally, the feet 26 extend far enough forward to provide adequate support for the upper body support apparatus 22 to prevent the entire system 20 from tipping when weight is applied.

Figure 2:
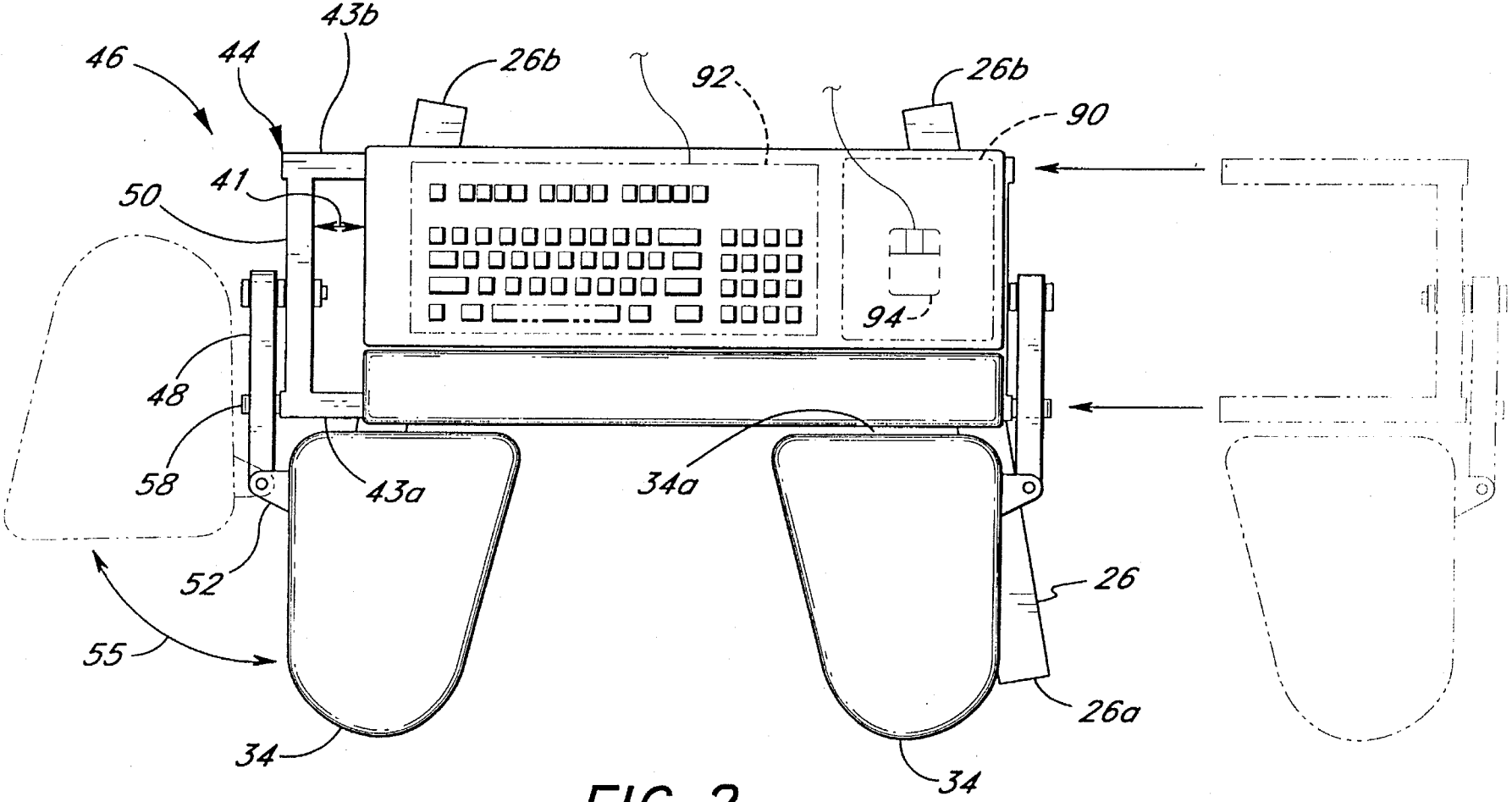
FIG. 2 is a top plan view of the apparatus of FIG. 1.
Figure 3B:
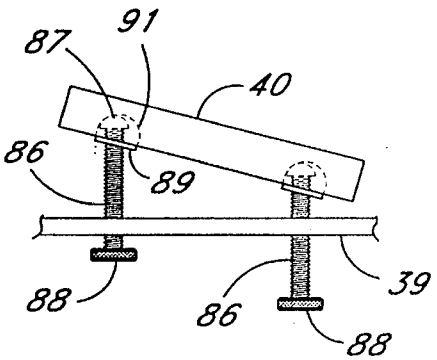
FIG. 3*b* is a detailed elevational view of a keyboard platform height/tilt adjustment mechanism in accordance with the present invention.
Figure 3A:
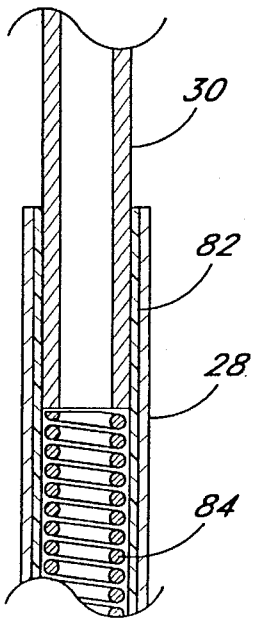
FIG. 3*a* is a cross-sectional view along a vertical support tube of the support apparatus taken along line 3*a*—3*a* of FIG. 3.
Figure 3:
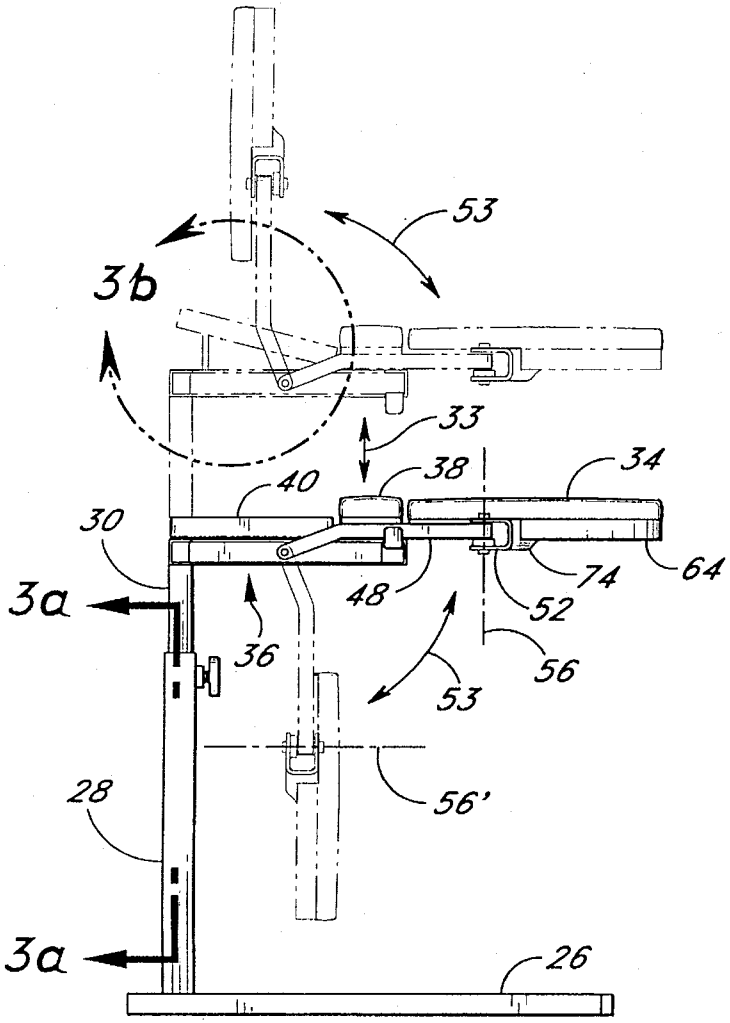
FIG. 3 is a side elevational view of the support apparatus of FIG. 1 showing various ranges of movement.

Now with reference to FIGS. 1–3, the upper body support 22 generally comprises a pair of arm rests 34 pivotable and slidable with respect to a horizontal subframe 36, and a padded wrist support 38 and keyboard platform 40 both mounted on top of the frame and together providing a work surface. Although not entirely shown in FIG. 1, the subframe 36 is disposed generally horizontally underneath the upper body support apparatus 22 and is mounted rigidly to the upper tubular stanchions 30. More particularly, the horizontal subframe 36 includes a pair of transverse tubular members 42*a*, 42*b*connected longitudinally by at least two tubular cross-members 37 and flat struts 39 (FIG. 3*b*). The rear tubular member 42*b*is rigidly attached to the top end of the upper stanchions 30, while the cross-members 37 connect the rear tubular member 42*b*to the front tubular member 42*a*, the connections preferably being welded.

In normal use, the arm rests 34 are mounted with respect to the horizontal subframe 36 to extend forwardly therefrom. More particularly, a rear edge 34*a*of each of the arm rests 34 lies coincident with a forward edge of the subframe 36, or adjacent the front tubular member 42*a*. The system 20 is designed so that a user may place a substantial weight on the arm rest 34 without the device tipping forward. To accomplish this, the feet 26 extend forward from the front tubular member 42*a* of the horizontal subframe 36. In a preferred embodiment, the feet 26 extend forward approximately the distance of the forwardly extending arm rests 34. As seen in FIG. 2, the front ends 26*a* of the feet are approximately directly underneath the front edges of the arm rests 34. This arrangement, along with the extremely sturdy construction of the system 20, ensures that the system will not tip or buckle when a user places his or her entire weight on the arm rests 34.

Advantageously, the position of the arm rests 34 can be optimally adjusted transversely to provide support for the arms from the elbow to the wrist close to the trunk of various individuals, whose sizes may differ greatly. Biomechanical analyses have determined that the line along the humerus, or upper arm bone, should be approximately vertical to result in the least amount of static musculoskeletal stress. The head of the humerus rotates within the glenoid cavity of the scapula, or shoulder blade, to define the shoulder joint. Primary movement of the humerus is about three orthogonal axes oriented relative to the plane of the scapula. Angulation of the humerus in the plane of the scapula about a generally transverse horizontal axis is termed abduction and adduction. Abduction is angulation of the upper arm away from the side of the body and adduction is toward the body. In general, one sitting for long periods typing should minimize abduction and maintain the upper arm in close elbow-to-body contact. Shoulder abduction associated with widely spaced arm supports may require excessive ulnar deviation of the hands for proper alignment of the fingers at the keyboard. Of course, with varying anatomies, the optimum position may vary somewhat, and to reduce the chance of suffering a chronic stress injury, the optimum position is that which places the muscles and tendons in the most relaxed position. More specifically, the average person can minimize chronic stress by maintaining the upper arm at an angle of between 0°–20°, and more preferably between 5°–15°, with the vertical.

The ability to transversely adjust the position of the arm rests 34 provides thus provides the capability to minimize chronic stress of the upper body muscles and tendons associated with excessive abduction of the upper arm. On each transverse end of the upper body support 22, the transverse frame members 42*a*, 42*b* are open to receive legs 43*a*, 43*b* of U-shaped frames 44 forming part of an arm rest support assembly 46. The U-shaped frame 44 can slide transversely with respect to the horizontal subframe 36 as shown by double arrow 41 of FIG. 2.

In addition to the U-shaped frames 44, the arm rest support assembly 46 includes a rigid linkage bar 48 pivotably mounted at a first end to a connecting section 50 (FIG. 2) of the U-shaped frame, and an arm rest bracket 52 adapted to pivot about a second end of the linkage bar in a pin and clevis arrangement. The entire arm rest assembly 46 can thus be slid transversely relative to the subframe 36 via the telescoping fit of the U-shaped frame legs 43*a* and 43*b* in the transverse tubular members 42*a* and 42*b*. Additionally, the linkage bar 48 and attached arm rest 34 can pivot about a transverse axis 54 (FIG. 1) through the first end of the linkage bar 48, as seen by arrows 53 in FIG. 3. Finally, the arm rest 34 can pivot about an axis 56 (FIG. 1) passing through the connection point with the second end of the linkage bar 48, as seen by the arrow 55 of FIG. 2. In the illustration of FIGS. 1 and 2, the axis 56 is substantially vertical, but with pivoting of the linkage bar 48 about the transverse axis 54, the orientation of the axis 56 will change. For example, the linkage bar 48 is shown rotated downward in phantom in FIG. 3 so that the reoriented axis 56' is substantially horizontal.

The arm rest support assembly 46 includes a variety of ranges of motion for positioning the arm rests 34 relative to an operator, or for pivoting the arm rests out of the way for storage or transport. In use however, the arm rests 34 are preferably positioned as shown in FIG. 1 with the linkage bar 48 resting horizontally on a rigid pin or catch member 58. As mentioned above, a rear edge 34*a*of the arm rests is coincident with a first edge of the horizontal subframe 36, or adjacent the front tubular member 42*a*. This optimum positioning provides a planar support surface for a user's wrist and forearm on the wrist pad 38 and arm rest 34. More particularly, the wrist pad 38 includes a rigid base fixedly attached to the horizontal subframe 36 and an upper cushion comprising a foam filled vinyl pad. The wrist pad 38 extends the entire transverse width of the keyboard platform 40 which, along with the transversely adjustable arm rest 34, provides the planar wrist and forearm support for users having varying girths. In order to hold the arm rests 34 in a desired position adjacent the front tubular member 42*a*, a pair of mating hook and loop fastening strips (not shown) may be provided on the tubular member and on the rear 34*a*of the arm rest.

The catch member 58 preferably comprises an element sized to fit within a front tubular leg 43*a* (FIG. 2) of each of the U-shaped frames 44. In the standard position shown, the catch member 58 extends outward from the U-shaped frame leg 43*a* so as to provide a support base for the linkage bar 48. The catch member 58 is sturdily constructed to support the weight of operator's arm and upper body as applied onto the arm rest 34. In order for the linkage bar 48 and arm rest 34 to pivot downward, the catch member 58 is simply slid inward into the tubular leg 43*a* of the U-shaped frame 44. A bent tab 60 (FIG. 1) or other such structure is provided to prevent the catch member 58 from sliding completely within the U-shaped frame 44. Other retractable catch members suitably rigid for supporting the weight of a user's upper body are possible, and the presently illustrated catch member 58 is shown as an example only.

An important feature of the upper body support apparatus 22 of the present invention is its sturdy construction. In particular, the arm rest support assembly 46 is preferably constructed of rugged steel components in contrast to prior designs. The intent is to provide support for the entire arms and upper body of a user rather than simply the wrist and forearm. To this end, the linkage bar 48 is preferably a solid, square cross-sectional bar pivotably attached at both ends with fairly large attachment bolts. Additionally, the arm rest bracket 52 and arm rest 34 itself are both very sturdily constructed, as detailed below.

Indeed, in one preferred embodiment, the entire standalone support body support system 20 includes a frame made of steel elements of 1.25 inch wide, 0.095 inch thick square tubing. As seen in FIG. 3*a*, the lower tubular stanchions 28 are slightly larger and thinner, preferably 0.065 inches in thickness, but possess sufficient structural strength to withstand most users applying their entire weight onto the arm rests 34. Similarly, the arm rest support assembly 46 is sturdily built of steel members. The particular steel used is somewhat malleable, however, to provide the advantageous dual qualities of strength and flexibility. This flexibility adds a further measure of comfort to a user leaning on the arm rests as the apparatus "gives" slightly. The feet 26 are desirably constructed of more sturdy rectangular channel members having a width greater than the height. In one embodiment, the feet 26 are constructed of 0.120 inch thick rectangular tubing having a width of 2 inches and a height of 1 inch. The preferred steel used for the structural members of the system 20 is a mild grade B steel having tensile strength of at least 60 kpsi, a yield strength of at least 50 kpsi, and having the capability of elongating at least 20% before rupture. One example of such mild steel is ASTM A500 having a tensile strength of 58 kpsi and a yield strength of 46 kpsi. The preferred steel may be replaced by other materials having suitable properties to ensure that excess loading of the system 20 will bend the structural members rather than breaking them.

Figure 4:
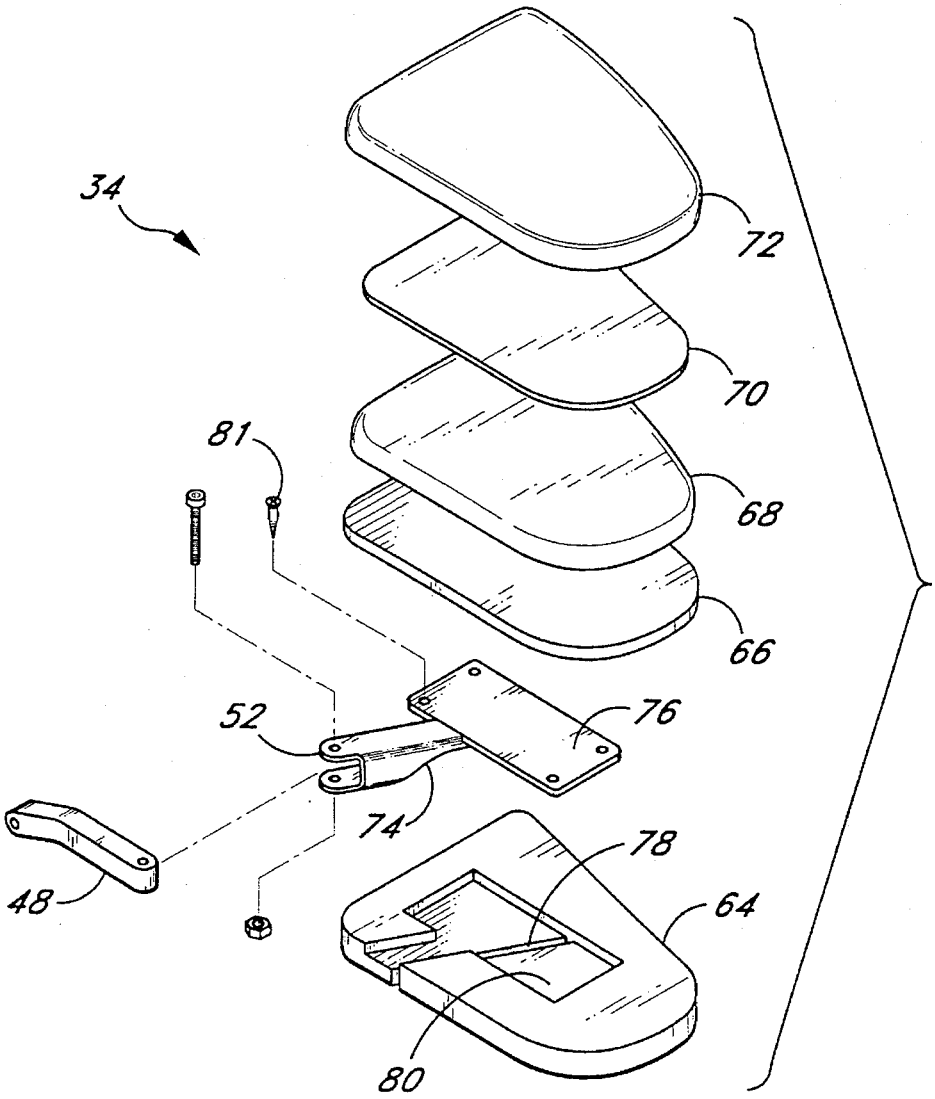
FIG. 4 is an exploded view of an arm rest and support assembly of the present invention.

With reference now to the exploded view of FIG. 4, the arm rest support 34 comprises a composite assembly having a fairly rigid skeleton and several layers of padding on the top. More specifically, the arm rest 34 comprises a lower panel of medium density fiberboard 64, an intermediate layer of plywood 66, a first layer of closed cell foam rubber 68, an upper layer of foam rubber 70, and an outer flexible covering 72 of vinyl or other similar expedient. The layers are stacked together with the medium density fiberboard 64 and plywood layers 66 being held together with wood screws or other such fasteners (not shown) and the foam rubber layers 68, 70 being adhered to the plywood and to each other. The vinyl covering 72 is preferably stretched over the arm rest 34 and held between the medium density fiberboard 64 and plywood layers 66. For increased strength, the arm rest bracket 52 is integrally formed with a generally vertical rib 74 and a connector plate 76. The rib 74 fits within a diagonal slot 78 cut into the medium density fiberboard 64 while the connector plate 76 is recessed in the top of the fiberboard in a cavity 80. The connector plate 76 is held rigidly to the fiberboard 64 by a plurality of fasteners, one of which is shown at 81. Advantageously, this construction is sturdy and avoids any downwardly depending support structure below the fiberboard layer 64. Thus, not only can a user support his or her entire weight on the arm rest 34, but the thin, layered construction provides a maximum amount of room underneath the arm rest 34, as best seen in FIG. 5*a*. Preferably, the arm rests are designed to support at least 200 lbs without bending.

The arm rests 34 are made to conform with existing fire safety regulations. More particularly, the present arm rests 34, being foam filled products which support a user's limb, are classified by governmental regulatory agencies as furniture, and thus are fire tested to conform with fire safety standards applicable to furniture. Presently, the arm rests 34 are rated by the California Department of Consumer Affairs, Home Furnishings Division, under Bulletins 116 and 117. Many smaller wrist pad supports for keyboard operators currently on the market are not classified as furniture as they do not "support" a limb or other body part and thus are not required to conform with these fire safety regulations.

Now with reference to FIG. 3*a*, the sliding interaction between the upper tubular stanchions 30 and lower tubular stanchions 28 is seen. A nonscratching polymer sleeve 82 is placed between the upper and lower stanchions to prevent scratching of the outer surface of the upper stanchion 30. The sleeve 82 is preferably an extrusion of ABS plastic. If the sleeve 82 were not provided, the upper stanchions 30 might become scratched and unsightly from repeated insertion and removal from the lower stanchions 28. In another advantageous feature, a relatively large helical spring 84 is placed within each of the lower tubular stanchions 28. The spring 84 has a diameter sized to fit within the inner channel of the upper tubular stanchions and such that the upper stanchion compresses the spring within the lower stanchion 28. The springs 84 have a length and spring stiffness such that the adjustable upper body support 22 is held at a height above a base which positions the upper body support apparatus 22 at a height convenient for the average sized user of the system 20. Thus, if the adjustable upper body support apparatus 22 needs to be raised up from this average height, it is less work for the user due to the springs 84. If the support apparatus 22 needs to be lowered, the user simply presses the apparatus down against the force of the springs 84 to the desired height and tightens the knobs 32 to retain the support apparatus 22 at this height.

Now, with reference to FIG. 3*b*, it can be seen that the height and angle of inclination of the keyboard platform 40 can be adjusted. More specifically, the horizontal subframe 36 includes a pair of generally flat struts 39 having threaded holes through which adjustment bolts 86 extend. There are four adjustment bolts 86—two on either lateral side of the subframe 36. Each pair of bolts 86 on each lateral side are preferably spaced from the front and back end of the keyboard platform 40, and thus are normally hidden. The bolts include adjustment knobs 88 which can be manipulated to change the height or the angle at which the keyboard platform is positioned with respect to the horizontal subframe 36. The upper end of each bolt 86 has a cap nut 87 captured by an apertured plate 89 within a recess 91 in the underside of the keyboard platform 40 to allow relative angular motion therebetween. The adjustment of the keyboard platform 40 allows the user to customize the keyboard angle and height for the various styles and sizes of keyboards on the market.

With reference to FIGS. 1 and 2 again, a mouse pad 90 is provided to fit on the keyboard platform 40 next to a keyboard 92. The mouse pad 90 includes a frictional upper surface on which a mouse 94 (FIG. 2) can be dragged to change the position of an arrow or cursor on the monitor of a computer. Advantageously, the keyboard platform 40 has a lateral width such that both the mouse pad 90 and keyboard 92 fit comfortably thereon. The location of the mouse pad 90 and keyboard 92 can be reversed to provide for left or right handed operation of the mouse 94. The mouse pad 90 is constructed of several laminated layers, and is preferably comprised of a lower layer of medium density fiberboard, an intermediate layer of plywood and an upper layer of closed cell foam rubber, covered by a flexible vinyl cover. The vinyl cover is preferably rougher than the cover provided on the arm rests 34 to allow for greater friction with the mouse 94. As previously mentioned, a planar support surface is provided along the arm rest 34 and wrist pad 38. With the provision of the mouse pad 90, a user can support his or her entire arm from the elbow all the way to the fingers along the three elements of the arm rest 34, wrist pad 38 and mouse pad 90. Such desirable and adjustable comprehensive arm and wrist support has previously been unavailable.

Figure 5B:
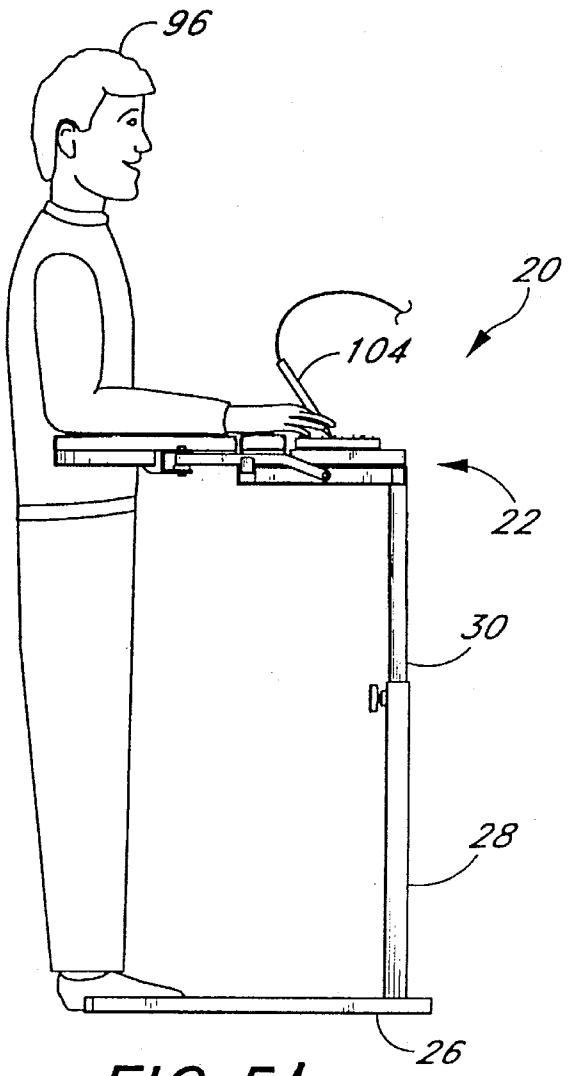
FIG. 5*b* is a side elevational view of the support assembly of FIG. 1 adapted for use by an assembly operator.
Figure 5A:
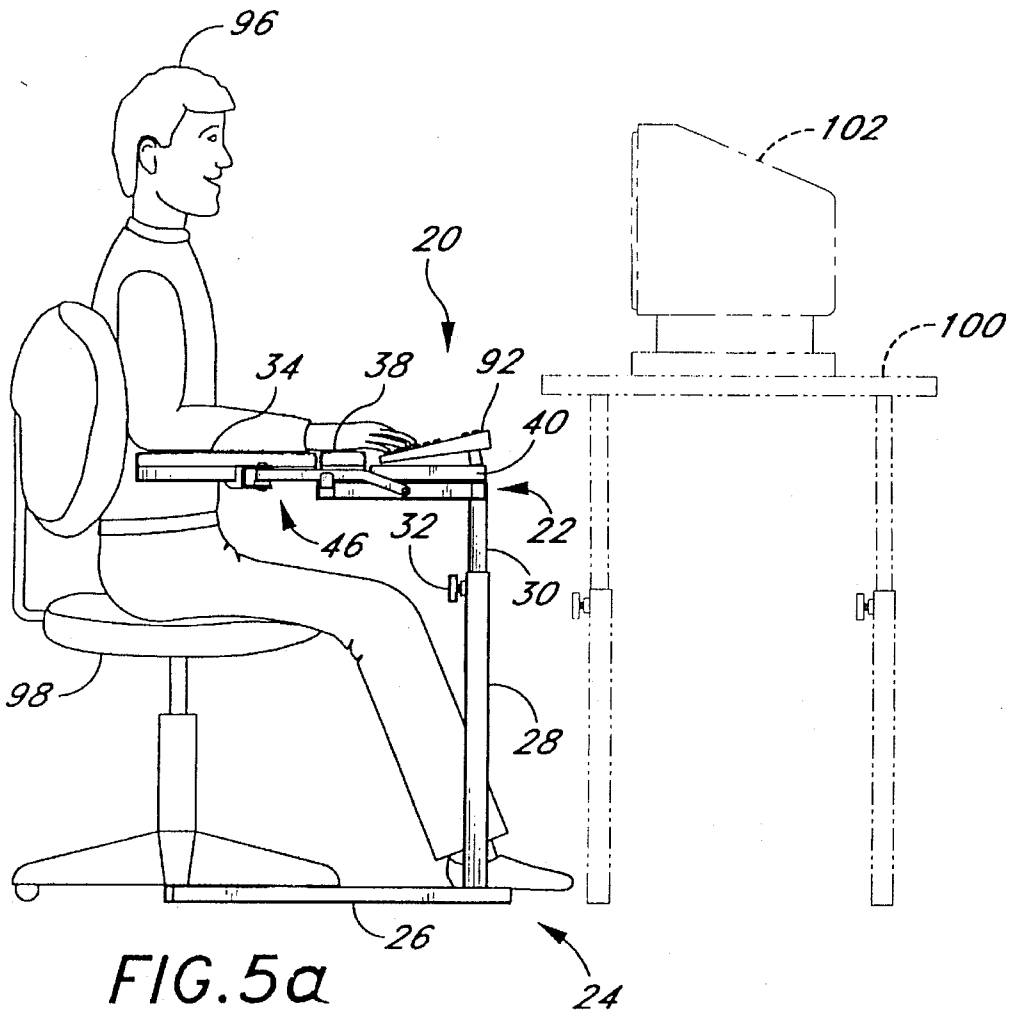
FIG. 5*a* is a side elevational view of the support assembly of FIG. 1 adapted for use by a keyboard operator.

Now with reference to FIGS. 5*a* and 5*b*, it can be seen that the standalone system 20 is extremely versatile in use. In FIG. 5*a*, a keyboard operator 96 sits at a chair 98 and rests his or her arms on the arm rests 34 with the wrists placed on the padded wrist supports 38. The keyboard 92 is preferably angled with respect to the horizontal subframe 36 to be optimally positioned with respect to the operator 96, via the tiltable platform 40 or by independent legs on the keyboard 92. The height of the upper body support assembly 22 has been adjusted via the knobs 32 of the stand 24 to an optimum position customized to the operator 96. A height-adjustable table 100 may be provided to work in conjunction with the standalone system 20 for supporting a monitor 102. Although it is preferred to have a separate height adjustable table 100 as shown, the standalone system 20 is constructed so that it can be collapsed downward to fit under most conventional desks for storage when not in use.

In FIG. 5*b*, the standalone system 20 has been raised up to provide a work platform for an operator 96 in a standing position. The system 20 may be used in this configuration for activities such as assembly of circuit boards utilizing a soldering gun 104, and the like. FIG. 5*b* best illustrates the sturdy geometry of the standalone system 20, wherein the line of force of the operator's arms is directly downward over the forwardly extended feet 26. Because the system 20 is constructed ruggedly, the operator 96 can apply a substantial weight to the upper body support 22 without the system buckling. Hence, the support assembly 22 is constructed and configured to allow the operator to adjust the system to a desired height whereby the wrists, arms and upper body are supported by the support assembly 22.

Combination Upper Body Support and Height Adjustable Desk

Figure 6:
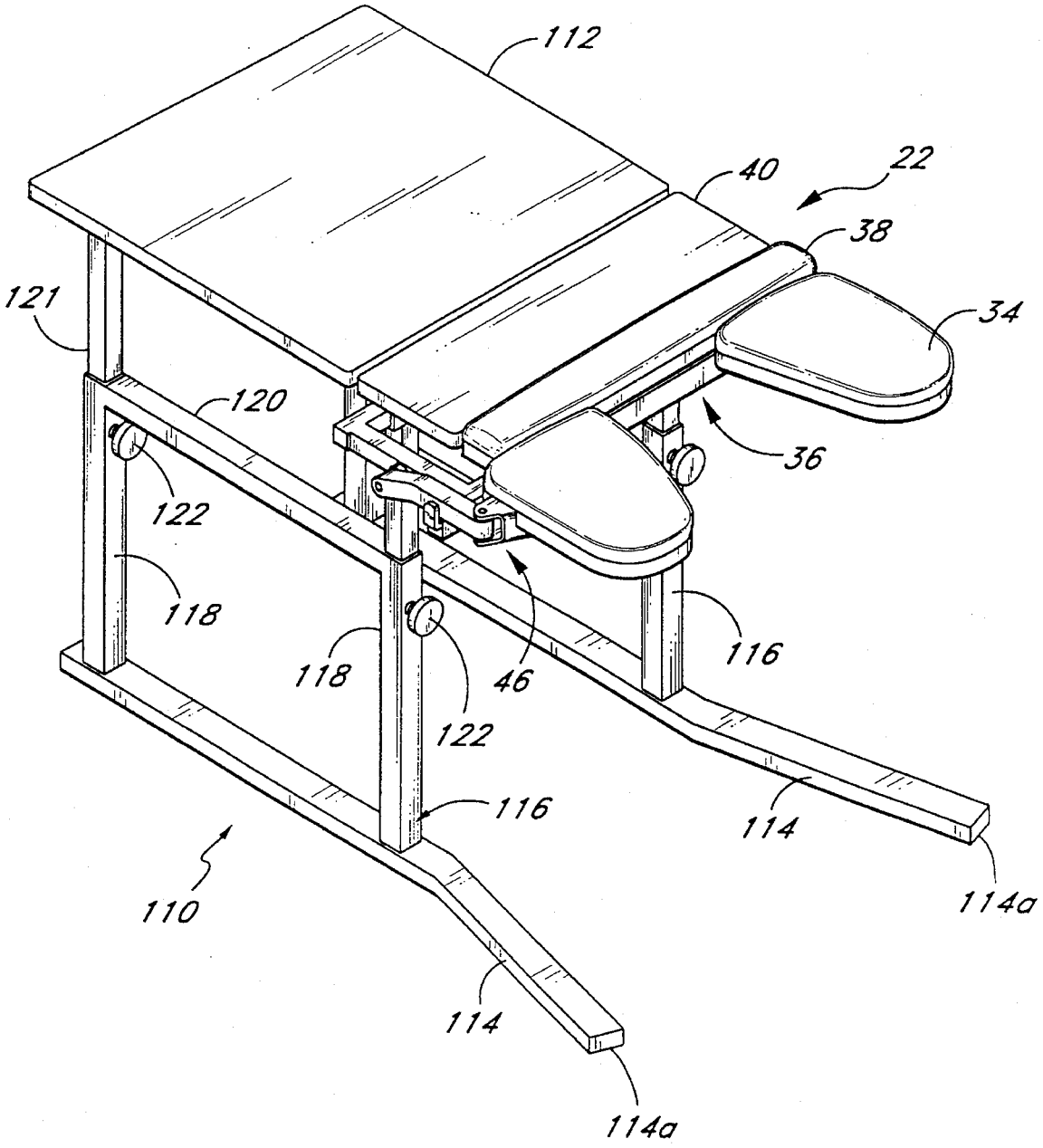
FIG. 6 is a perspective view of a second embodiment of an upper body support assembly incorporating a height adjustable work platform.

Now with reference to FIG. 6, the upper body support assembly 22 can be incorporated into a frame 110 which supports a height adjustable work platform 112. In this version, the frame 110 comprises a pair of elongated divergent feet 114 from which two inverted U-shaped frame members 116 are attached. The frame members 116 include upwardly extending tubular legs 118 and a horizontal crosspiece 120. The elongated feet 114 extend generally parallel between each pair of legs 118 and then diverge in a forward direction. Preferably, the feet 114 are bent at an approximately 15° angle forward of the front vertical legs 118. Such a divergence provides increased maneuver room between the front ends 114*a* for wheelchair-bound users, for instance.

At the upper end of the legs 118, apertures are formed for receiving vertical stanchions 121 attached to the upper body support assembly 22 and to the work platform 112. A pair of adjusting knobs 122 for both the upper body support stanchions and the height adjustable work platform stanchions are provided. The upper body support assembly 22 is substantially as described with reference to FIGS. 1–5 and will not be described further, except to say that it comprises the arm rests 34, the horizontal subframe 36, the padded wrist support 38, the keyboard platform 40 and the arm rest support assembly 46.

Figure 7:
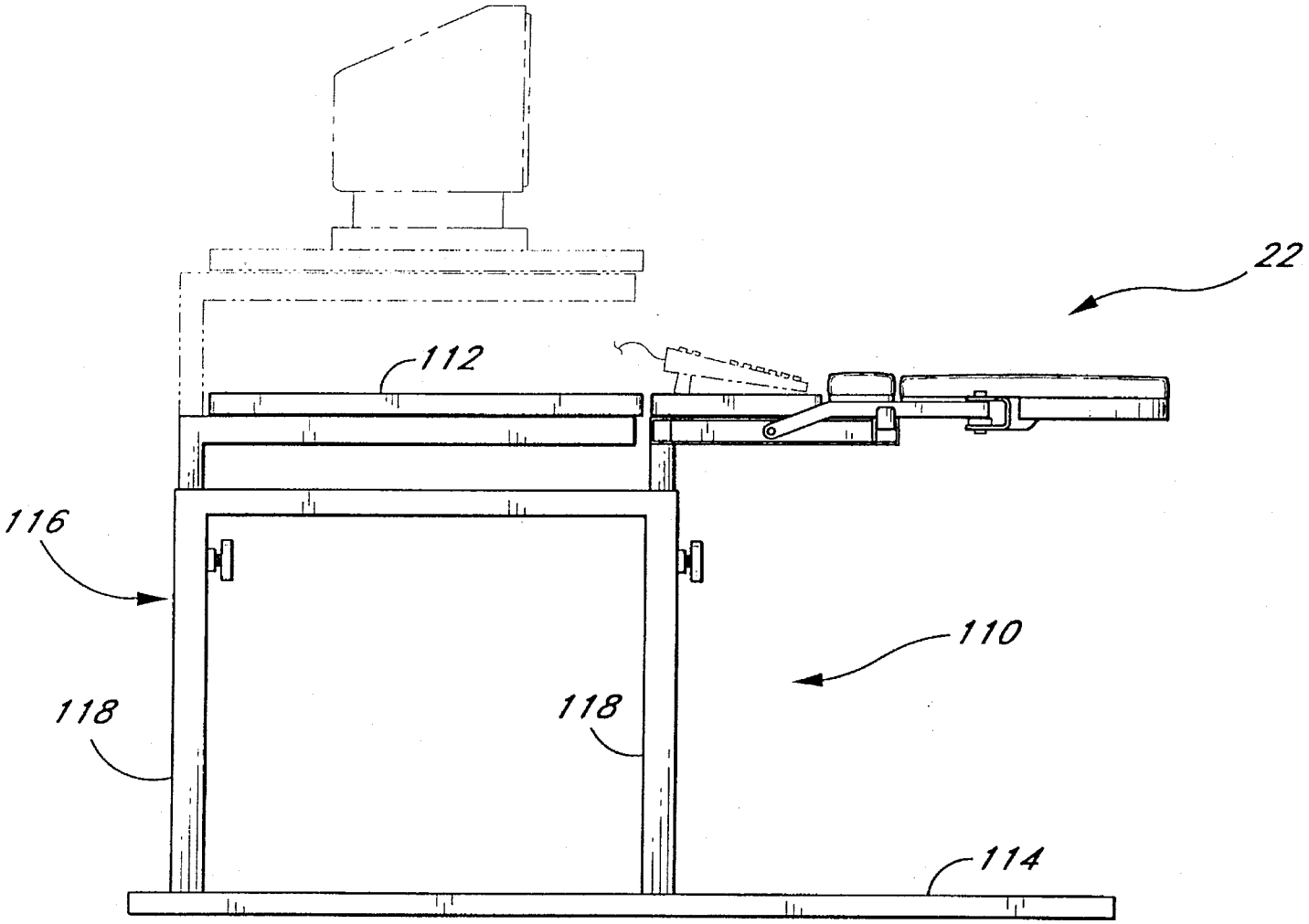
FIG. 7 is a side elevational view of the second support assembly embodiment of FIG. 6.

FIG. 7 shows the various ranges of motion of the height adjustable work platform 112. In this version, the work platform 112 and the upper body support assembly 22 are independently height adjustable to customize their positions for each user. Again, springs (not shown) are placed within the vertical legs 118 of the bridge-shaped member 116 to maintain a neutral height at a position optimized for the average person. In one preferred embodiment, both the upper body support assembly 22 and work platform 112 are adjustable between 24 inches and 29 inches off the ground.

Combination Upper Body Support and Surrounding Workstation

Figure 8:
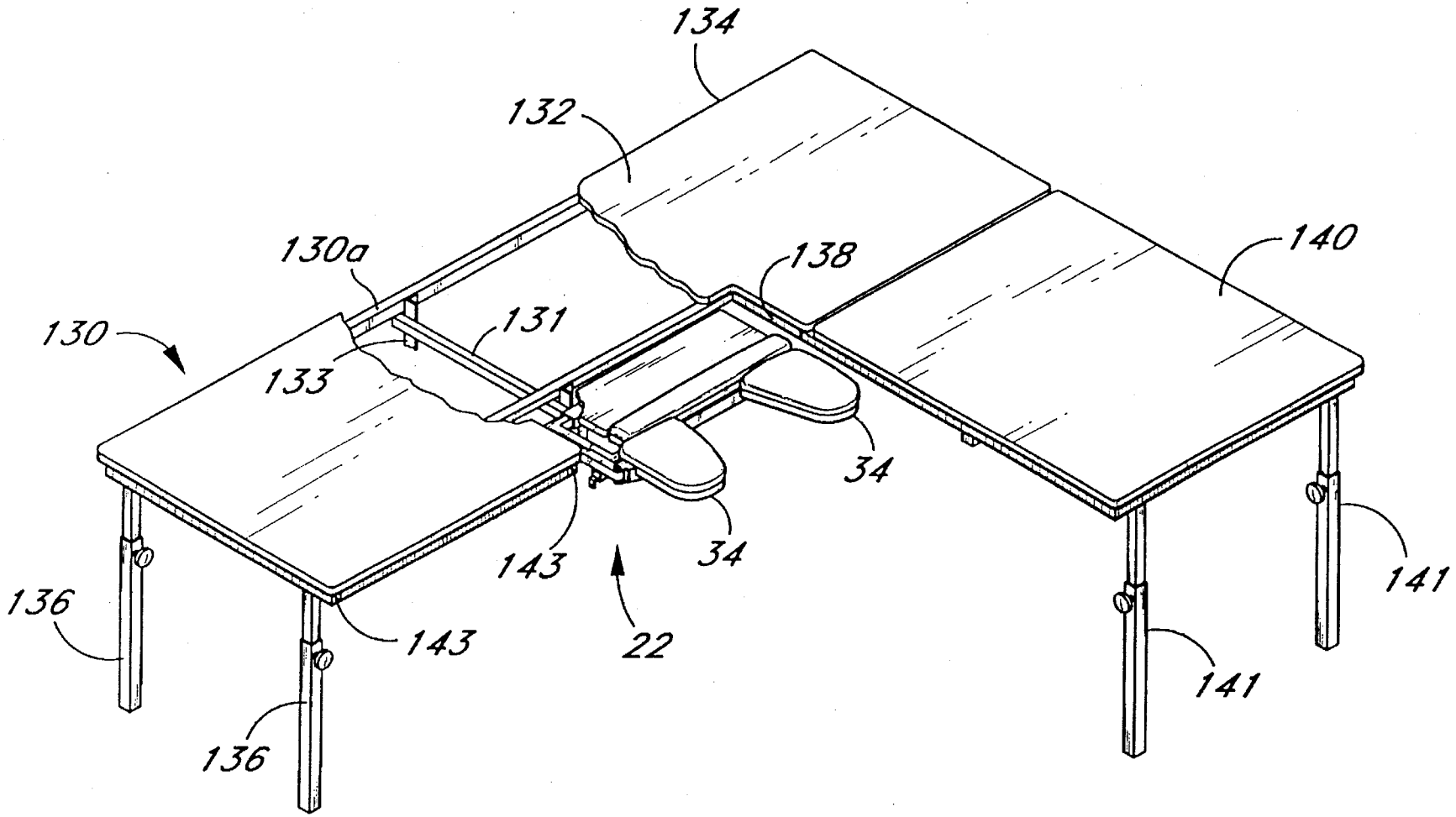
FIG. 8 is a perspective view of a third embodiment of the upper body support apparatus incorporated into a larger desk workstation.

In FIG. 8, an alternative workstation surrounding the upper body support assembly 22 is shown. In this embodiment, the workstation comprises a relatively large L-shaped desk 130 surrounding the upper body support assembly 22. The upper body support assembly 22 is preferably fixedly mounted at the same height as the desk 130 by structural members underneath the desk. The upper body support assembly 22 is mounted so that the arm rests 34 can pivot, in the same manner as previously described in reference to FIG. 3, underneath the desktop 132. In a preferred embodiment, the upper body support assembly 22 includes a pair of rearwardly extending members 131 attached rigidly to downwardly depending brackets 133 from the frame **130*a* of the desk. This arrangement is schematically shown in FIG. 8, although other arrangements for affixing the frame of the upper body support assembly 22** to the desk frame may be utilized.

In the preferred embodiment, the desk 130 is formed in two pieces with a main body portion 134 having four height adjustable legs 136 on each corner and a central cut-out portion 138 on one side for the upper body support assembly 22. A side extension 140 having two height-adjustable legs 141 attaches to one of two positions relative to the main body 134. More particularly, the side extension 140 may be coupled to either the left or right side of the upper body support assembly to vary the desk 130 layout. The side extension 140 includes a pair of rod-like extensions which fit within apertures in the main body 134. In FIG. 8, the apertures 143 on the left side of the main body 134 are exposed. There may be structure underneath the desk sections 134, 140 to couple them temporarily together, as is well known by those of skill in the art. In the illustration of FIG. 8, the side extension 140 is attached to the right side of the upper body support assembly 22. The legs 141 of the side extension 140 provide the necessary structural support for a user placing his or her whole body weight on the arm rests 34. In other words, the side extension 140 takes the place of the elongated feet 26 and 114 of the first two embodiments.

Combined Upper Body Support and Corner Workstation

Figure 9:
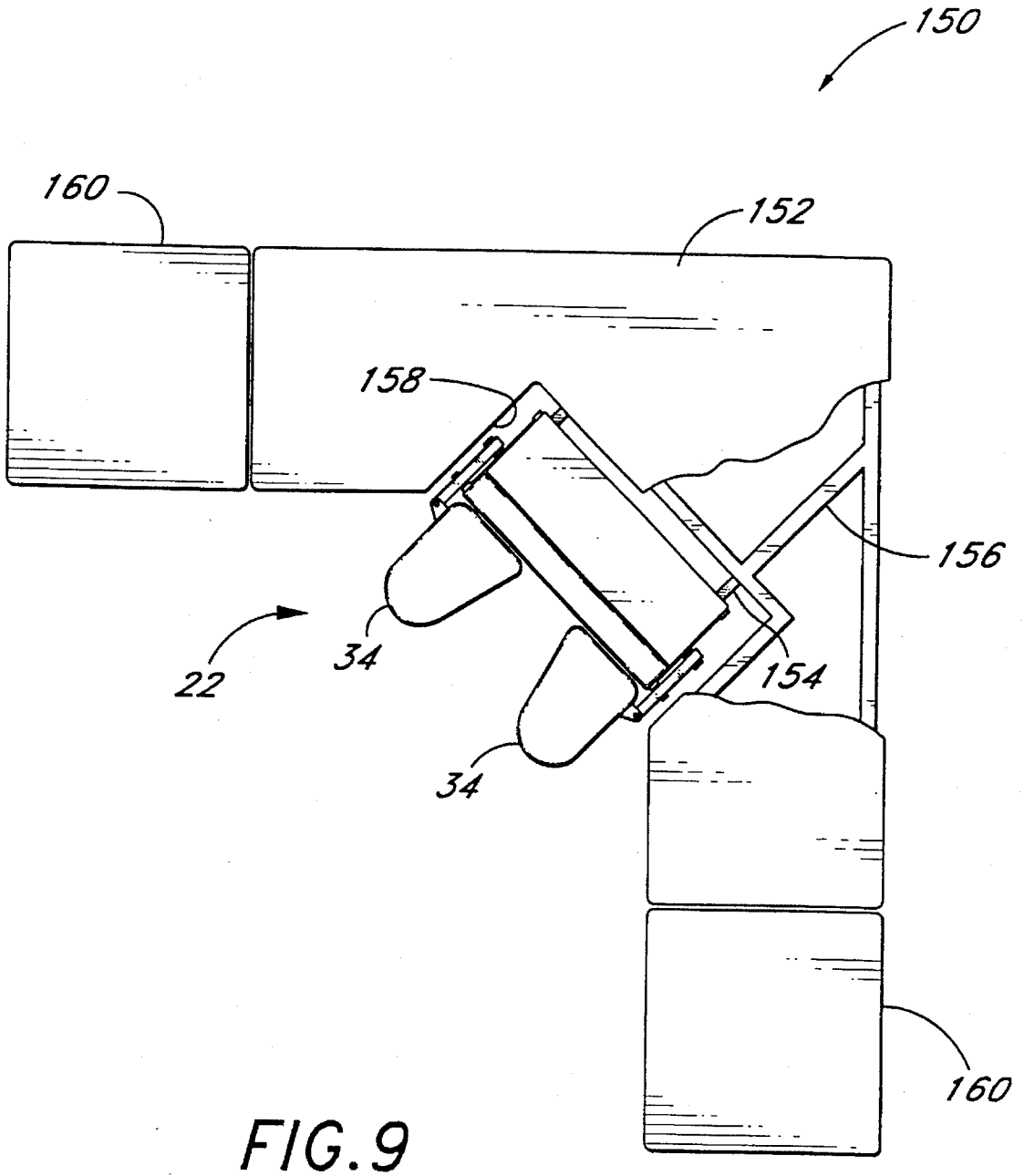
FIG. 9 is a top plan view of a further corner desk workstation incorporating the upper body support apparatus of the present invention.

As shown in FIG. 9, a further alternative workstation 150 is shown. The workstation 150 is shown in plan view with a portion 158 of a central desk 152 cutaway to expose the structure frame members underneath. In this version, the upper body support apparatus 22 includes a pair of rearwardly extending members 154 which fit within tubular frame members 156 of the workstation 150. The members 154 can be rigidly attached to frame members 156 or can be slidable therein to enable removal of the upper body support apparatus 22. This configuration may be replaced by a more rigid structure, such as in the workstation 130 of FIG. 8. The main body 152 of the workstation 150 is formed in a right angle with the central cutout 158 for accommodating the upper body support apparatus 22. A pair of end extensions 160 can be added to increase the desktop area of the workstation 150, as was described for the side extensions 140 of FIG. 8. Again, the arm rests 34 can be slid outward and pivoted as was described for the first embodiment of FIGS. 1–5.

It will now be apparent to the reader that the present system, whether embodied in a standalone version 20 or into autonomous workstations, provides an extremely sturdy upper body support for a user. The provision of the forwardly extending feet and desk extensions provide an anti-tip support structure which allows one to place his or her entire weight on the arm rests of the invention without fear of the device tipping forward, as contrasted with previous add-on devices of the prior art. A further primary advantage of the present invention is the ability to vertically adjust the arm rests and keyboard platform to suit the individual user. Once the optimum height of the upper body support apparatus is fixed, the user may then adjustably position the arm rests to their individual width. Finally, the system provides a planar support surface for the user's arm extending from the elbow all the way to the fingers. Such comprehensive, sturdy support for a user such as a keyboard operator will help prevent the occurrence of repetitive strain injuries.

Standalone Workstation with Central Mouse Pad and Optional Side Table

Figure 10:
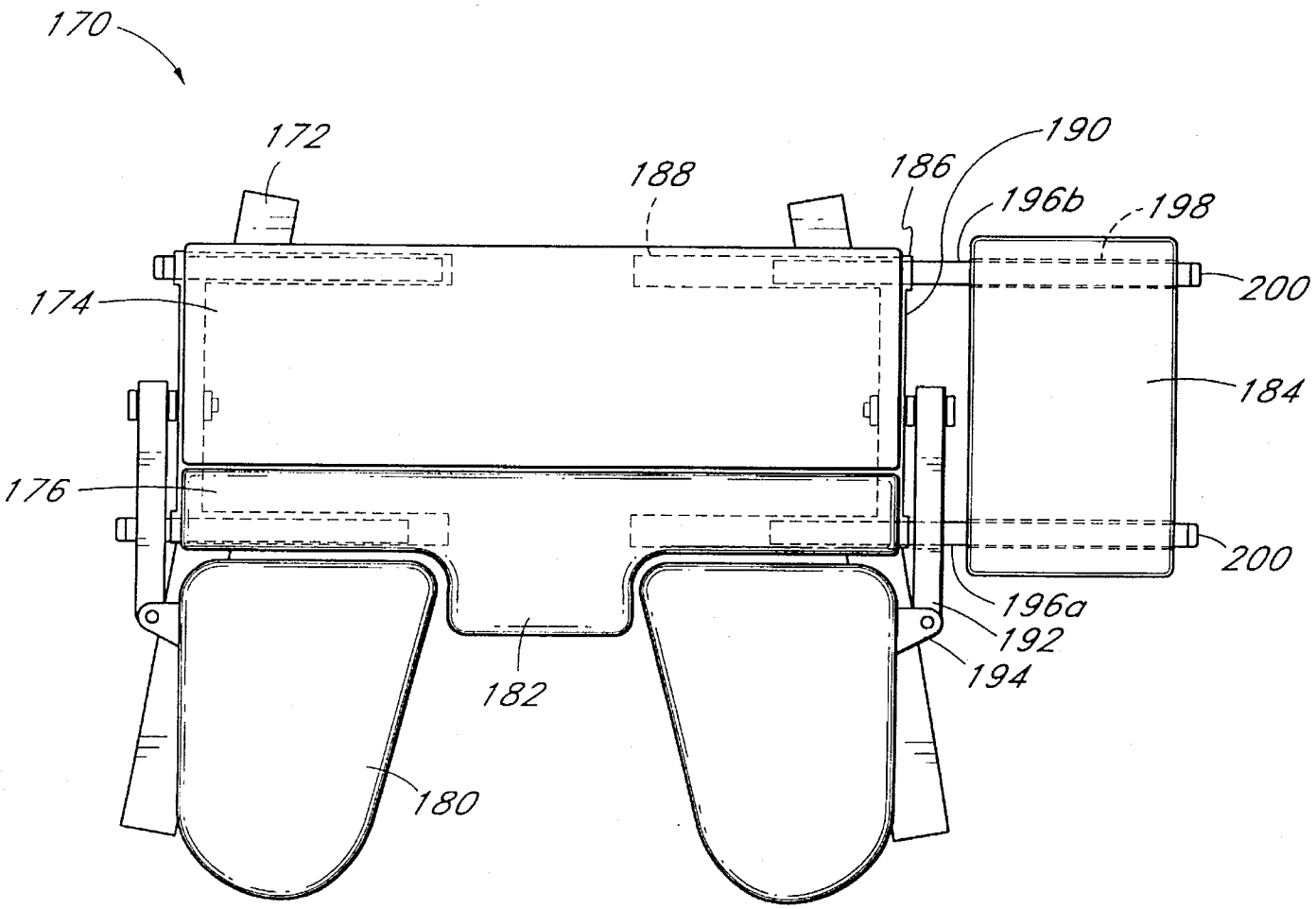
FIG. 10 is a top plan view of an alternative embodiment of the standalone upper body support apparatus incorporating a central mouse pad and optional side table.

FIG. 10 illustrates an alternative embodiment of a stand workstation 170 in many ways similar to the system 20 shown in FIG. 1 but with two design changes. The workstation 170 comprises the lower legs 172 having upright tubular stanchions (not shown) attached thereto and supporting a generally horizontal subframe (not shown but similar to the subframe 36 described for FIG. 1). The subframe supports a keyboard platform 174, a wrist pad 176 and a pair of arm rest support assemblies 178 for a pair of arm rests 180.

The wrist pad 176 is generally constructed in an identical manner to the wrist pad 38 described previously, and preferably includes a rigid base fixedly attached to the horizontal subframe and an upper cushion comprising a foam-filled vinyl pad. The previously described wrist pad 38 was positioned at the front edge of the subframe 36 and extended the entire width of the subframe. The front-to-back dimension of the wrist pad 38 is three or four inches, or approximately one-quarter of the full front to back dimension of the subframe 36.

The alterative wrist pad 176 shown in FIG. 10, on the other hand, includes the main transverse body portion extending the entire width of the subframe and also has a central forwardly extending mouse pad 182 adjacent the arm rests 180. This mouse pad extension 182 extends forwardly a distance approximately equal to the front-to-back distance of the main body portion of the wrist pad 176. In a preferred embodiment, the mouse pad extension 182 is unsupported by the subframe and is formed as an integral unit with the main body portion of the wrist pad 176. Other arrangements are possible, however, such as a longer forwardly extending mouse pad extension fully supported underneath by the subframe, or an extension which is manufactured as a separate piece from the main body portion of the wrist pad but of similar construction so that when the two components are juxtaposed they define a planar upper surface. Desirably, the wrist pad extension 182, wrist pad 176 and arm rests 180 are configured to provide coplanar upper support surfaces which combine to form a continuous platform for the entire wrist, forearm and upper body of the operator.

The alternative standalone workstation 170 further includes an optional side table 184 capable of being positioned on either side of the subframe. Each arm rest support assembly 178 comprises a U-shaped frame 186 defined by a pair of transversely extending frame legs 188 and a central connecting portion 190. The U-shaped frame 186 is slidable transversely within the horizontal subframe, as was previously described. A rigid linkage bar 192 is pivotably connected to the connecting portion 190 to rotate about a horizontal axis relative thereto. The linkage bar 192 is also rotatably coupled at its other end to an arm rest support bracket 194 which is rigidly attached to the arm rest 180. The entire arm rest support assembly 178 is thus substantially identical to the arm rest support assembly 46 as previously described.

In a divergence from the previous arm rest support assembly 46, the alternative support assembly 178 includes a pair of elongated sliding members or side table support bars **196*a*, 196*b* which extend transversely through side apertures into the U-shaped frame legs 188. The front sliding member 196*a* functions as a catch member to support the linkage bar 192 and arm rest 180, in a similar manner to the previously described catch member 58. In addition, the front and rear sliding members 196*a* and 196*b* may be extended transversely outward relative to the U-shaped frame 186 to provide coplanar supports for the side table 184. It is contemplated that a positive lock may be provided for each sliding member 196*a* and 196*b* to fix its transverse position with respect to the U-shaped frame 186. Such a lock may be a set screw arrangement, a pin in cooperation with a series of holes in the sliding members 196*a*, and 196*b*** or other such structure well known in the art.

The side table 184 may be configured in any number of ways for various applications but is preferably, in the simplest embodiment, a separate flat platform, padded or otherwise, with a pair of transverse stabilizer rails 198 extending vertically downward underneath. The stabilizer rails 198 are spaced apart a sufficient distance to extend on either side of the sliding support members **196*a* and 196*b*. In this manner, the side table 184 is prevented from forward or rearward movement. Furthermore, the sliding support members 196 are provided with upwardly extending end tabs 200 which prevent the side table 184 from sliding outwardly past their ends, and also to prevent the sliding members from sliding completely into the tubular U-shaped frame legs 188. The tab 200 on the front sliding support member 196*a* also abuts against the linkage bar 192 when the front sliding member 196*a* functions as a catch member. In the preferred embodiment, there are two pairs of sliding support members 196*a* and 196*b* provided so as to be able to position the side table 184 on either side of the workstation 170. If preferred, the side table 184 can be removed completely and the sliding members 196*a* and 196*b* retracted fully into the U-shaped frames 186**.

Although this invention has been described in terms of certain preferred embodiments, other embodiments that are apparent to those of ordinary skill in the art are also within the scope of the invention. Accordingly, the scope of the invention is intended to be defined only by reference to the appended claims.

What is claimed is:

1. An arm support apparatus configured to be positioned on a ground surface comprising:

a work surface having a front, a back and at least two sides;

at least one arm support mechanically connected to the work surface so as to be slidably positionable along at least a portion of the front of said work surface and wherein said at least one arm support is vertically movable with respect to said ground surface and thereby being positionable adjacent a user of the work surface so that said user's upper arm is substantially vertical and said user's forearm being substantially horizontal and supported by said at least one arm rest from the elbow substantially to the wrist of said user to thereby provide arm and upper body support for said user, and said arm support being horizontally rotatable about a location outward from a side of the work surface such that said arm support pivots outward and away from said front of said work surface and swings toward said side of said work surface, thereby providing a clear path for movement of said user with respect to the work surface when arm support is not desired by said user.

2. The arm support apparatus as defined in claim 1, wherein said arm support is pivotable vertically about a location outward from the side of the work surface so as to store said arm support away from interference with the user's access to the work surface.

3. The arm support apparatus as defined in claim 1, further comprising a support member mechanically connected to the work surface, a portion of said support member being horizontally extendable outward from a side of the work surface, and said arm support being connected to said portion of said support member in a configuration such that the slidable position of said arm support is determined by the position of said support member.

4. The arm support apparatus as defined in claim 3, wherein the location about which said arm support horizontally rotates comprises a connection location between said arm support and said support member.

5. The arm support apparatus as defined in claim 4 wherein said arm support is pivotably connected to said support member at a pivot location outward from the side of the work surface such that said arm support is pivotable vertically about said pivot location so as to store said arm support away from interference with the user's access to said work surface.

6. An arm support apparatus as defined in claim 5 further comprising a support structure mechanically connected to the work surface and to the support member for supporting said work surface and said support member with respect to the ground, and wherein said support apparatus is vertically adjustable to maintain said work surface at a desired height above said ground surface.

7. The arm support apparatus as defined in claim 6 wherein said support structure comprises a pair of vertical legs each connected at an upper portion of the leg to a portion of the support structure that is adjacent the back of the work surface, and at a lower portion of the leg to a horizontal support defining a foot, wherein each said foot extends from a vertical leg outward beyond the front of the work surface so as to provide cantilevered support for the work surface.

8. The arm support apparatus as defined in claim 3, further comprising a mouse pad positioned on said support member and adjacent to the work surface such that the mouse pad can be accessed by the user's hand while the user's arm is supported on said arm support.

9. The arm support apparatus as defined in claim 1, wherein said arm support extends forward from said work surface a sufficient distance so that a user can be positioned in front of the work surface and the arm support extends to the side of the user, said arm support being slidably positionable into a range of positions for supporting the arm of various users in optimum ergonomic positions relative to the side of the user.

10. The arm support apparatus as defined in claim 9, comprising two arm supports wherein said arm supports are slidably positionable so as to minimize abduction of both upper arms of a variety of users.

11. The arm support apparatus as defined in claim 9, comprising two arm supports wherein said arm supports can be slidably positioned to support both upper arms at an angle of between 0°–20° from the vertical for a variety of users.

12. The arm support apparatus as defined in claim 11, wherein said arm supports can be slidably positioned to support both upper arms at an angle of between 5°–15° from the vertical for a variety of users.

13. The arm support apparatus as defined in claim 1 further comprising:

a support member mechanically connected to the work surface, a portion of said support member being horizontally extendable outward from a side of the work surface and mechanically connected to said arm support to provide said slidable positioning of said arm support; and a height-adjustable support structure supporting said work surface and said support member with respect to said ground surface, wherein said arm support is thus height-adjustable, and wherein the height and the sideways position of said arm support can be adjusted to position the arm support at an ergonomically optimum position with respect to a variety of users, said ergonomically optimum position minimizing repetitive stress injuries.

14. The arm support apparatus as defined in claim 13 comprising two arm supports wherein said arm supports are slidably positionable so as to minimize abduction of both upper arms of a variety of users.

* * * * *